US007607744B2

(12) United States Patent
Casoli et al.

(10) Patent No.: US 7,607,744 B2
(45) Date of Patent: Oct. 27, 2009

(54) DOMESTIC REFRIGERATOR PROVIDED WITH SHELVES

(75) Inventors: Fiorenzo Casoli, Vergiate (IT); Giorgio Giudici, Lonate Pozzolo (IT); Giuseppina Arresta, Ternate (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/914,595

(22) PCT Filed: May 15, 2006

(86) PCT No.: PCT/EP2006/062293

§ 371 (c)(1),
(2), (4) Date: May 21, 2008

(87) PCT Pub. No.: WO2006/122913

PCT Pub. Date: Nov. 23, 2006

(65) Prior Publication Data

US 2008/0271474 A1 Nov. 6, 2008

(30) Foreign Application Priority Data

May 17, 2005 (IT) ..... VA2005A0035

(51) Int. Cl.
*A47B 96/02* (2006.01)

(52) U.S. Cl. ..... 312/408; 211/153

(58) Field of Classification Search ..... 312/401, 312/408, 410, 351, 228.1, 282, 313, 334.1, 312/334.7; 211/150, 153, 90.01, 90.02, 90.04; 126/332, 337 R, 339; 62/382; 108/6, 9, 108/106, 107, 108, 147.16
See application file for complete search history.

(56) References Cited

U.S. PATENT DOCUMENTS 2,091,607 A * 8/1937 Nave ..... 211/153

(Continued)

FOREIGN PATENT DOCUMENTS

DE 3544446 1/1987

(Continued)

*Primary Examiner*—James O Hansen
(74) *Attorney, Agent, or Firm*—Kirk W. Goodwin; McGarry Bair PC

(57) ABSTRACT

A domestic refrigerator comprises a cavity (c) with side walls (10*a*) provided with removable opposing supporting elements (16) and having guides (22) capable of co-operating with lateral sliders (26) for shelves (14) in order to permit the latter to be positioned at different heights. Said shelves (14) comprise two planar portions (18, 20) articulated with one another, a first portion (18), which is more extensive in the manner of a leaf, co-operating with the guides (22, 22*a-d*) with the aim of being able to assume two stable positions at different heights, a second portion (20) in the manner of a bracket co-operating rotatably with seats for said supporting elements so as to be able to assume a first configuration substantially coplanar with the leaf and a second configuration angled relative to the latter.

12 Claims, 2 Drawing Sheets

U.S. PATENT DOCUMENTS 2,146,199 A * 2/1939 Barnhardt ..... 211/153
2,189,240 A * 2/1940 Burr ..... 126/338
2,251,799 A * 8/1941 Nave ..... 312/408
2,262,578 A * 11/1941 Ellis ..... 211/153
2,307,233 A * 1/1943 Opgenorth ..... 312/408
2,319,470 A * 5/1943 Nobles ..... 211/153
2,376,640 A * 5/1945 Wall et al. ..... 99/426
2,565,845 A * 8/1951 Frederick ..... 312/246
2,980,483 A * 4/1961 Davis ..... 312/271
3,625,371 A * 12/1971 Dill ..... 211/153
3,690,744 A * 9/1972 Squire ..... 312/351
3,977,334 A * 8/1976 Carroll ..... 108/134
4,437,572 A * 3/1984 Hoffman ..... 211/119.003
4,528,825 A 7/1985 Khan
4,646,658 A * 3/1987 Lee ..... 108/143
4,662,523 A * 5/1987 Stein et al. ..... 211/59.2
5,813,741 A * 9/1998 Fish et al. ..... 312/408

FOREIGN PATENT DOCUMENTS

DE 19750473 5/1999
JP 2002350025 12/2002
JP 2003247776 9/2003
WO 2005001352 A1 1/2005

* cited by examiner

DOMESTIC REFRIGERATOR PROVIDED WITH SHELVES

CROSS-REFERENCE TO RELATED APPLICATIONS

This application claims priority on International Application No. PCT/EP2006/062293, filed May 15, 2006, which claims priority on Italian Application No. VA2005A000035, filed May 17, 2005.

The present invention relates to a domestic refrigerator of the type comprising a cavity with side walls provided with removable opposing supporting elements equipped with guides capable of co-operating with side sliders for shelves in order to allow the shelves to be positioned at different heights.

Such a refrigerator is described in patent application EP-A 1460360 in the name of the applicant. The advantage provided by using removable supporting elements on the side walls of the cavity is well known and is primarily that of ensuring easier cleaning of said walls, which are smooth and lack the conventional grooves (in which dirt can sometimes accumulate) for guiding and supporting the shelves. Furthermore, the presence of said guides permits easy displacement of the shelves to different levels without having to extract the shelves from the cavity, as is the case in conventional refrigerators.

Although said known solution provides considerable advantages over conventional refrigerators, manoeuvring of the shelves in the guides is still subject to possible snagging of the sliders in the guides, especially when the shelf is not caused to translate in parallel manner. Such possible snagging of the sliders in the guides can occur when the user is using only one hand to manoeuvre the shelf, a situation which occurs particularly frequently when using a refrigerator. Furthermore, it is possible that, when said shelves are being manoeuvred, they can escape from the guides, with the consequent risk of the shelves falling.

The aim of the present invention is to provide a domestic refrigerator of the type specified at the beginning of the description, which does not have the above-stated disadvantages and which is simple and economic to produce.

According to the invention, this aim is achieved by virtue of the fact that at least one of said refrigerator shelves comprises two planar portions articulated with one another, a first portion co-operating with the above-stated guides so as to assume two positions at different heights, a second portion co-operating rotatably with seats for said supporting elements in order to be able to assume a first configuration substantially coplanar with the first portion of the shelf and a second configuration angled relative to the first portion.

Thanks to the above-stated features, manoeuvring of the shelf between two levels at different heights is not subject to problems either of snagging or of accidental dropping and can be performed with just one hand. This is made possible because translational parallelism of the first portion of the shelf is ensured by the rotation of the second portion of said shelf in the above-stated seats for the supporting elements.

Each of said guides is preferably substantially V-shaped and comprises a leg for insertion of the sliders and an operational leg that ends at the top in a turned-down seat capable of retaining the respective slider stably in a predetermined position. Thanks to said further feature, the shelves can be inserted into the guides particularly easily and quickly, and furthermore the two stable positions of the shelf are ensured by the lower vertex of each V guide and by the turned-down seat provided at the upper end of one of the two legs of the V guide.

Further advantages and features of the present invention will emerge from the following detailed description, which is provided purely by way of non-limiting example, with reference to the attached drawings, in which.

Figure 1:
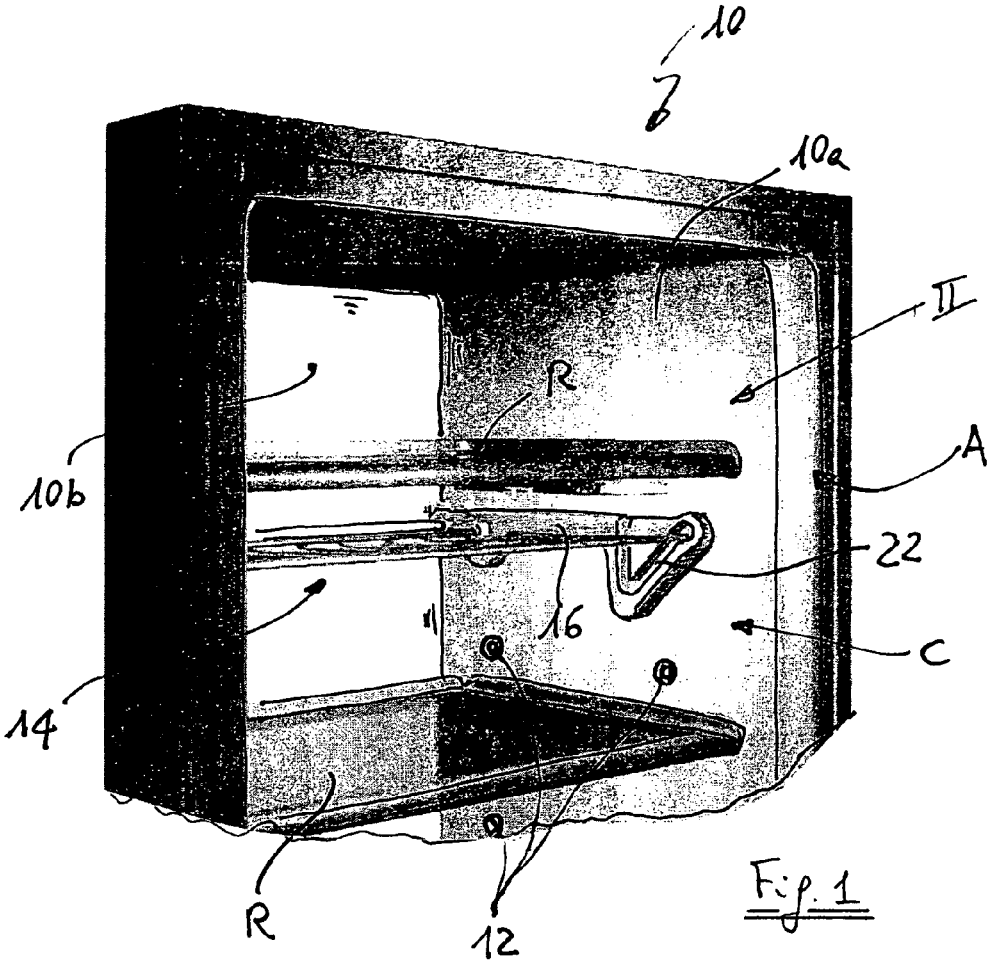
FIG. 1 is a perspective view of part of a refrigerator according to the invention.

With reference to the drawings, 10 denotes overall a refrigerator according to the invention having a cavity C delimited by side walls 10*a* and by a back wall 10*b*. The cavity C defines, in a manner known per se, a front opening A capable of being closed by a door (not shown).

A plurality of seats 12 for installation of the shelves are provided on the side walls 10*a* of the cavity C. Said shelves can be of known type, denoted in the drawings with the reference R, or shelves according to the invention, in which case they are denoted by the reference 14. As is shown in detail in FIG. 3, each shelf 14 comprises two side supports 16 of polymeric material (for example ABS) capable of being fixed to the side walls 10*a* at the seats 12, and two planar elements respectively 18 and 20 articulated to one another and supported by the side supports 16. To this end, each support 16, substantially elongated in shape, comprises, close to one of its ends 16*a* and facing the opening A of the cavity C, a substantially V-shaped guide groove 22, which has a vertical insertion leg 22*a* on an upper edge of the support 16, a vertex 22*b* and an inclined leg 22*c* ending in a turned-down seat 22*d*. At an end 16*b* opposite the front end 16*a*, each support 16 has a circular seat 24, the function of which will become clear from the following description.

A first planar element or leaf 18 of the shelf 14 comprises, on the sides and level with its front edge 18*a*, a pair of sliders 26 capable of co-operating with the V guides 22. In the example shown in the drawings, the sliders 26 are defined by the ends of a metal bar 26*a* that defines the front edge 18*a* of the leaf 18 made from stainless-steel or painted rod, but said sliders could obviously be provided in a different manner, for example as an integral part of a frame of polymeric material in the case that the shelf was of the composite type (a sheet of glass enclosed in a frame). Similarly, the leaf 18 has at the rear a metal bar 28*a*, the ends of which define two pins 28 for articulation at 20*a* with the second planar element or bracket 20. The bracket 20 is preferably made from polymeric material and comprises a planar portion 20*b* and two side profiles 20*c* in which are located either the above-stated seats 20*a* for articulating with the pins 28 of the leaf 18 or two side pins 30 capable of co-operating rotatably with the seats 24 of the side supports 16.

Figure 2:
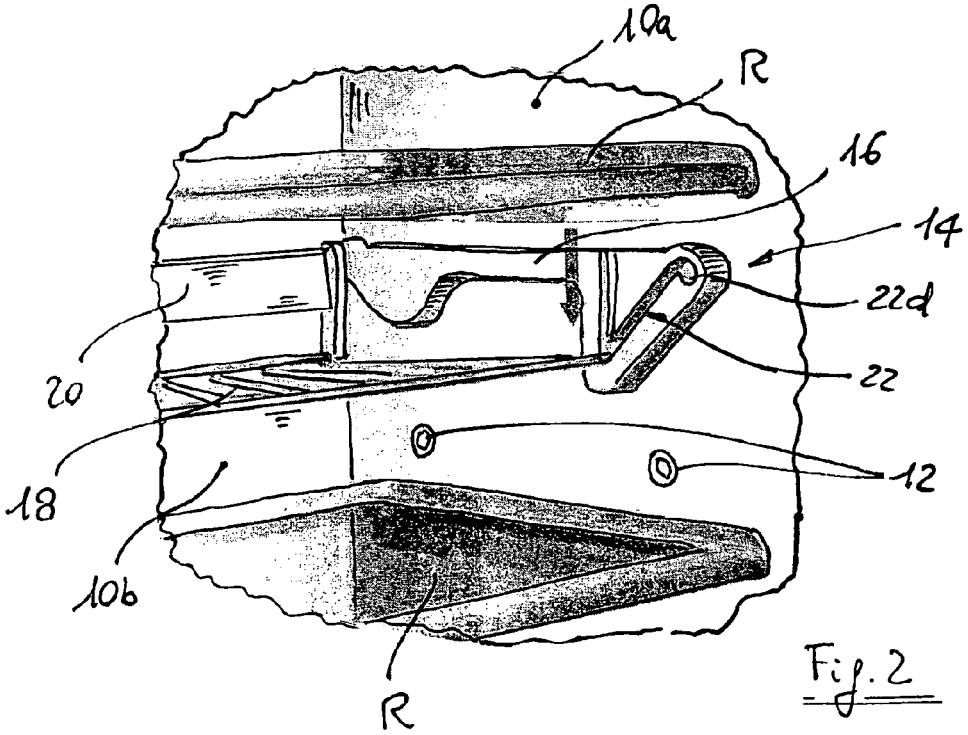
FIG. 2 is a larger-scale view of a detail in FIG. 1, in which the shelf that is the subject-matter of the invention is illustrated in a different configuration.
Figure 4:
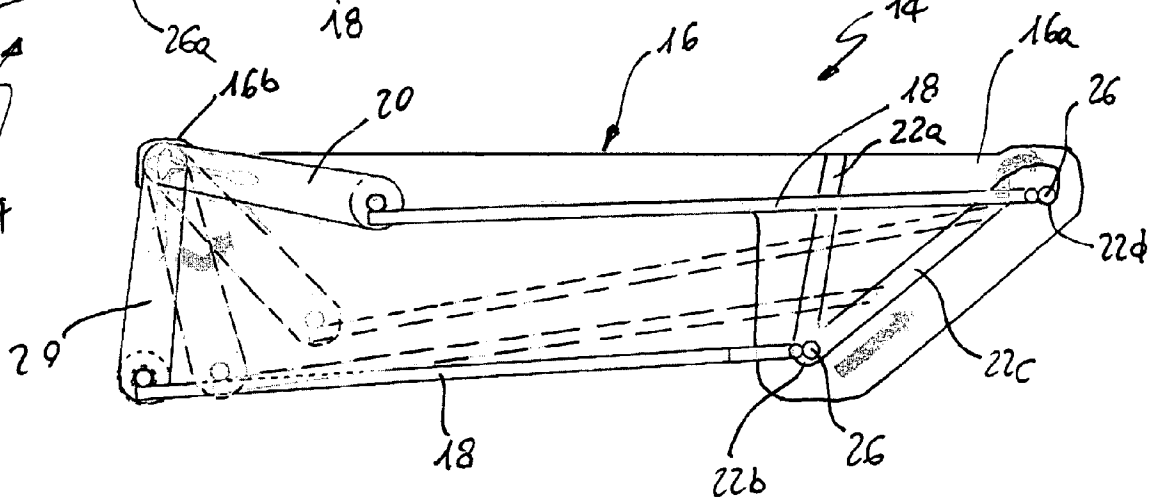
FIG. 4 is a schematic side view that illustrates the manoeuvring of said shelf between the two operational positions.

Installation of the shelf 14 in the refrigerator is very simple and is performed as follows. The user positions the supports 16 at the desired height and fixes them to the walls 10*a* of the cavity C by means of a known fixing system. The assembly constituted by the leaf 18 and the bracket 20 articulated to one another at 28 and 20*a* is then introduced into the cavity C, the side pins 30 of the bracket 20 being inserted into the seats 24, and the sliders 26 of the leaf 18 into the vertical insertion leg 22*a* of the V guides 22. In this manner, the shelf 14 assumes the "low" configuration shown for example in FIG. 2. In this configuration, the bracket 20 assumes a substantially vertical position, while the sliders 26 are stably supported by the vertices 22*b* of the guides 22. When the user wants to put the shelf 14 into a "high" position, all that is required is to exert traction on the leaf 18 towards the opening A of the cavity C so as to cause the sliders 26 to slide in the inclined legs 22*c* of the guides 22, as shown in FIG. 4 in which the intermediate positions assumed by the leaf 18 and the bracket 20 are shown with dashed lines. On completion of this movement, the sliders 26 are inserted into the turned-down seats 22*d* so as to prevent the guides from slipping back along the inclined legs 22*c* of the guides. In this configuration (shown for example in FIG. 1), the leaf 18 and the bracket 20 are substantially coplanar with one another. When the user wants to return the shelf 14 to its "low" configuration, all that is required is to lift the leaf 18 up slightly so that the sliders 26 disengage from the turned-down seats 22*d* and can slide under the action of gravity towards the vertices 22*b* of the guides 22.

The double articulation of the shelf both at the seats 24 and at the articulated joint between the leaf 18 and bracket 20 ensures movement of the leaf without snagging of the sliders 26 in the guides 22.

Figure 3:
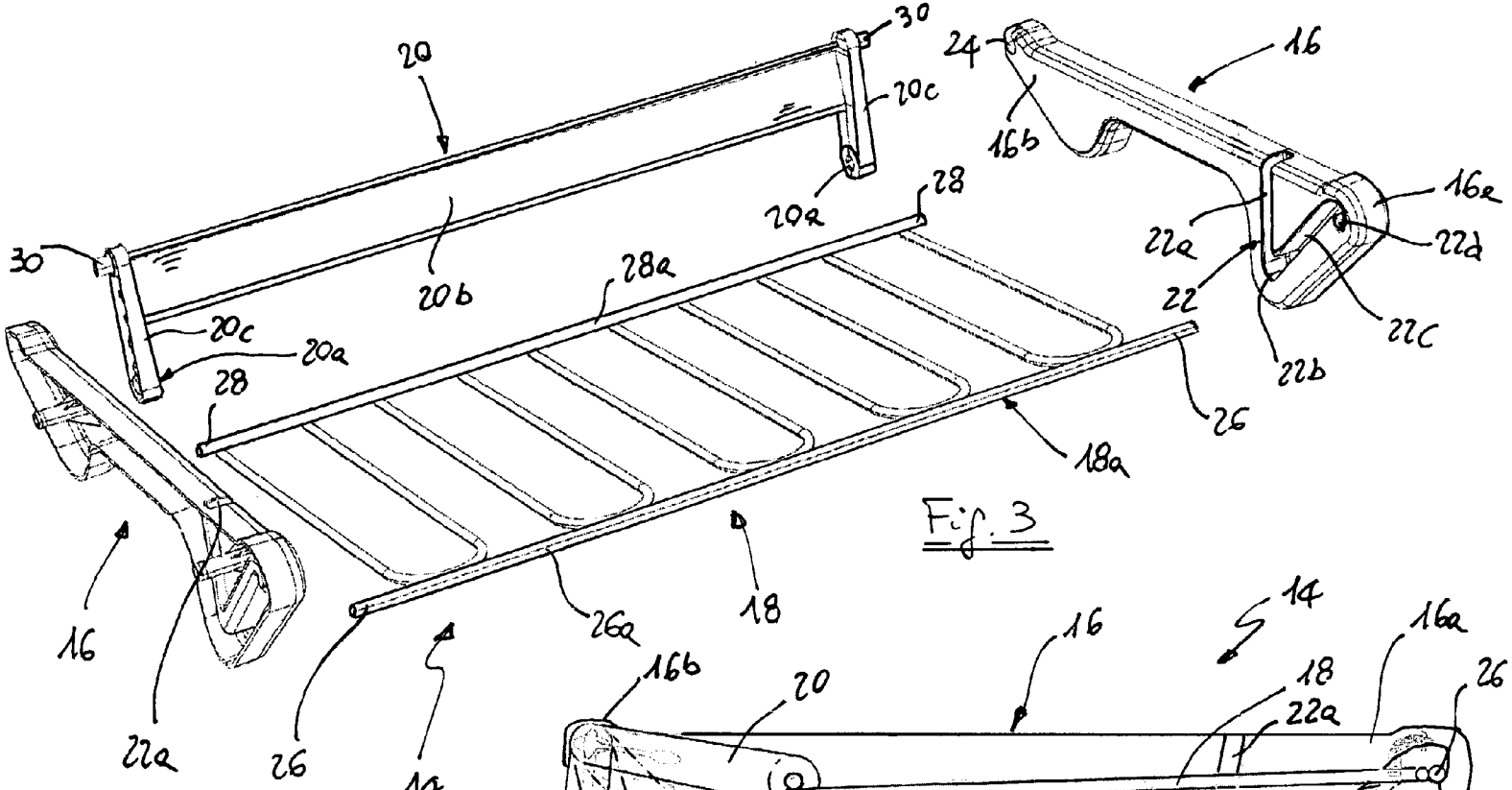
FIG. 3 is an exploded perspective view of the shelf shown in FIGS. 1 and 2.

The shelf according to the invention, in particular in the embodiment shown in FIG. 3, is useful both as a stand/support for bottles or similar containers, which are located stably between the longitudinal bars, which define seats, of the leaf. Furthermore, in the lowered position of the shelf, thanks to the configuration slightly inclined towards the rear that is assumed by the leaf, it is possible to support already opened bottles without any risk of liquid leaks.

The invention claimed is:

1. A domestic refrigerator comprising:

a plurality of walls defining a cavity;

opposing supporting elements provided within the cavity, each supporting element being elongated and having a guide at one end and a seat at an opposite end; and a shelf comprising two planar portions articulated with one another, a first portion having sliders received within the guides to slidably move between first and second stable positions at different heights, a second portion rotatably mounted to the seats to rotate between a first configuration substantially coplanar with the first portion and a second configuration angled relative to the first portion;

wherein the first portion is in the first stable position when the second portion is in the first configuration, the first portion is in the second stable position when the second portion is in the second configuration, and sliding movement of the first portion between the first and second stable positions affects rotation of the second portion between the first and second configurations; and wherein each of said guides is substantially V shaped and comprises an insertion leg for receipt of the sliders and an operational leg that ends at the top in a turned-down seat capable of retaining the respective slider stably in the first stable position.

2. The domestic refrigerator according to claim 1, wherein the insertion leg is substantially vertical and forms, together with the operational leg, a vertex for retaining the first portion of the shelf in the second stable position.

3. The domestic refrigerator according to claim 1, wherein the guides are arranged in a zone of the supporting elements adjacent to a front opening of the cavity.

4. The domestic refrigerator according to claim 1, wherein the turned-down seat of each guide and the seat capable of co-operating with the second portion of the shelf are arranged substantially in the same horizontal plane.

5. The domestic refrigerator according to claim 1, wherein the first portion and the second portion of the shelf are substantially orthogonal to one another in the second position.

6. The domestic refrigerator according to claim 1, wherein the first portion of the shelf is provided with seats for supporting bottles arranged in a horizontal or inclined configuration.

7. A domestic refrigerator comprising:

a plurality of walls defining a cavity;

opposing supporting elements provided within the cavity, each supporting element being elongated and having a guide at one end and a seat at an opposite end; and a shelf comprising two planar portions articulated with one another, a first portion comprising sliders received within the guides and co-operating with the guides to slidably move between first and second stable positions at different heights, a second portion co-operating rotatably with and mounted to the seats in order to rotate between a first configuration substantially coplanar with the first portion and a second configuration angled relative to the first portion;

wherein each of said guides is substantially V shaped and comprises an insertion leg for receipt of the sliders and an operational leg that ends at the top in a turned-down seat capable of retaining the respective slider stably in the first stable position.

8. The domestic refrigerator according to claim 7, wherein the insertion leg is substantially vertical and forms, together with the operational leg, a vertex for retaining the first portion of the shelf in the second stable position.

9. The domestic refrigerator according to claim 7, wherein the guides are arranged in a zone of the supporting elements adjacent to a front opening of the cavity.

10. The domestic refrigerator according to claim 7, wherein the turned-down seat of each guide and the seat capable of co-operating with the second portion of the shelf are arranged substantially in the same horizontal plane.

11. The domestic refrigerator according to claim 7, wherein the first portion and the second portion of the shelf are substantially orthogonal to one another in the second stable position.

12. The domestic refrigerator according to claim 7, wherein the first portion of the shelf is provided with seats for supporting bottles arranged in a horizontal or inclined configuration.

* * * * *